US008723772B2

(12) United States Patent
Yang et al.

(10) Patent No.: US 8,723,772 B2
(45) Date of Patent: May 13, 2014

(54) LIQUID CRYSTAL DISPLAY PANEL HAVING DIFFERENT SUB-PIXELS ARRANGEMENT GROUPS

(75) Inventors: Yu-Chung Yang, Hsin-Chu (TW); Kuo-Chang Su, Hsin-Chu (TW); Yung-Chih Chen, Hsin-Chu (TW); Kuo-Hua Hsu, Hsin-Chu (TW); Chih-Ying Lin, Hsin-Chu (TW); Kun-Yueh Lin, Hsin-Chu (TW)

(73) Assignee: AU Optronics Corp., Hsinchu (TW)

( * ) Notice: Subject to any disclaimer, the term of this patent is extended or adjusted under 35 U.S.C. 154(b) by 294 days.

(21) Appl. No.: 13/204,941

(22) Filed: Aug. 8, 2011

(65) Prior Publication Data

US 2012/0120035 A1 May 17, 2012

(30) Foreign Application Priority Data

Nov. 15, 2010 (TW) ..... 99139245 A

(51) Int. Cl.
*G09G 3/36* (2006.01)

(52) U.S. Cl.
USPC ..... 345/88

(58) Field of Classification Search
USPC ..... 345/88
See application file for complete search history.

(56) References Cited

U.S. PATENT DOCUMENTS

| | | | | |
|---|---|---|---|---|
| 7,199,775 | B2 | 4/2007 | Igarashi et al. | |
| 2007/0091044 | A1 | 4/2007 | Park et al. | |
| 2010/0110046 | A1 | 5/2010 | Chen et al. | |
| 2010/0123652 | A1 | 5/2010 | Chen et al. | |
| 2010/0156947 | A1 * | 6/2010 | Moon et al. | 345/690 |
| 2010/0302215 | A1 * | 12/2010 | Tsai et al. | 345/204 |
| 2010/0315402 | A1 * | 12/2010 | Hashimoto | 345/211 |

FOREIGN PATENT DOCUMENTS

| | | |
|---|---|---|
| CN | 1746959 | 3/2006 |
| TW | 201019026 | 5/2010 |
| TW | 201019296 | 5/2010 |
| TW | 201110085 | 3/2011 |

* cited by examiner

*Primary Examiner* — Long D Pham
(74) *Attorney, Agent, or Firm* — WPAT, PC; Justin King

(57) ABSTRACT

A LCD panel with an improved pixel array configuration is provided. The LCD panel uses a column inversion driving method to drive the data lines so as to achieve a stable common voltage. Moreover, by cross-connecting the layout traces of the wiring zone in a specified manner, the gate pulses outputted from every two gate lines neighboring the sub-pixel are not overlapped with each other, so that the frame can be normally displayed.

10 Claims, 9 Drawing Sheets

LIQUID CRYSTAL DISPLAY PANEL HAVING DIFFERENT SUB-PIXELS ARRANGEMENT GROUPS

TECHNICAL FIELD

The disclosure relates to a LCD panel, and more particularly to a LCD panel integrating a gate driver on array (GOA) circuit.

BACKGROUND

A typical LCD panel comprises plural gate lines connected to a gate driver and plural data lines connected to a data driver (also referred as a source driver). For effectively reducing the number of data lines to reduce the fabricating cost, a LCD panel with a tri-gate pixel configuration has been disclosed. In the tri-gate pixel configuration, the sub-pixels R, G and B of each pixel are sequentially arranged along the data line. In such way, the number of gate drivers is tripled to constitute a complete frame. As known, a LCD panel integrating a gate driver on array (GOA) circuit may reduce the overall fabricating cost.

FIG. 1A is a schematic circuit diagram illustrating a conventional LCD panel, which is disclosed in US Patent Application No. US2007/0091044. The LCD panel has a tri-gate pixel configuration. As shown in FIG. 1A, the LCD panel comprises a data driver and a pixel array. The data driver comprises plural data driver integrated circuits 141, which are connected with m data lines D1~Dm. The gate driver is connected with 3n gate lines G1~G3n. The gate driver comprises a first gate driver integrated circuit 150L and a second gate driver integrated circuit 150R. The gate driver integrated circuit 150L is connected with the odd-numbered gate lines. The second gate driver integrated circuit 150R is connected with the even-numbered gate lines.

For example, the pixel PX11 comprises three sub-pixels, which are controlled by the gate pulses from a first gate line G1, a second gate line G2 and a third gate line G3, respectively. For enhancing the display quality and reducing the overall power consumption of the LCD panel, the data lines are driven by a column inversion driving method. As a result, the driving polarities of every two adjacent data lines are opposite at the same time. Generally, a common voltage Vcom is received by the LCD panel. The data line having a voltage value higher than the common voltage has a positive polarity (+). The data line having a voltage value lower than the common voltage has a negative polarity (−).

The way of arranging the sub-pixels of the LCD panel of FIG. 1A, however, may incur some drawbacks during the process of displaying some regular frames. For example, when the voltages of the data lines are simultaneously changed from a low-level state to a high-level state or simultaneously changed from the high-level state to the low-level state, the common voltage Vcom may be deviated from the original level because of a coupling effect. Under this circumstance, the voltage levels for writing to the sub-pixels are adversely affected, and thus the displaying quality of the frame is usually deteriorated.

FIG. 1B is a schematic timing waveform diagram illustrating the signal change of the LCD panel of FIG. 1A when bright/dark vertical fringes are displayed. The common voltage Vcom is 4 volts. The even-numbered data lines have the negative polarity. The odd-numbered data lines have the positive polarity. If the voltage value of the data line is equal to the common voltage Vcom, the sub-pixels corresponding to the data line are in the full-bright state. Whereas, if the voltage value of the data line is equal to 0V or 8V, the sub-pixels corresponding to the data line are in the full-dark state.

Obviously, in a case that the data lines of the LCD panel are driven by a column inversion driving method to display the bright/dark vertical fringes, the voltage of the even-numbered data lines (e.g. the second data line D2 and the fourth data line D4) are alternately changed between 4V and 0V in response to the gate pulses (G1~G12) of the gate lines. Similarly, the voltage of the odd-numbered data lines (e.g. the third data line D3 and the fifth data line D5) are alternately changed between 8V and 4V in response to the gate pulses (G1~G12) of the gate lines. In such way, the bright/dark vertical fringes are shown on the frame.

As can be seen from FIG. 1B, when the voltages of the data lines are simultaneously changed from a low-level state to a high-level state or simultaneously changed from the high-level state to the low-level state (i.e. in the transition condition), the common voltage Vcom may be deviated from the original level because of a coupling effect. Under this circumstance, the voltage levels for writing to the sub-pixels are adversely affected, and thus the displaying quality of the frame is usually deteriorated.

Please refer to FIGS. 2A and 2B. FIG. 2A is a schematic circuit diagram illustrating a gate driver according to the prior art. FIG. 2B is a schematic timing waveform diagram illustrating associated signals processed by the gate driver of FIG. 2A. The gate driver 410 comprises plural shift register units 411~418. According to four clock signals C1~C4, the shift register units 411~418 generate four gate pulses g1~g4 to the gate line G1~G4 of the visible zone 420, respectively. The operations of the gate driver 410 will be illustrated in more details as follows.

In response to a start signal ST, the first shift register unit 411 and the second shift register unit 412 issue the first gate pulse g1 and the second gate pulse g2 to the first gate line G1 and the second gate line G2 according to the first clock signal C1 and the second clock signal C2, respectively. The third shift register unit 413 is informed by the first shift register unit 411 to issue the third gate pulse g3 to the third second gate line G3 according to the third clock signal C3. The fourth shift register unit 414 is informed by the second shift register unit 412 to issue the fourth gate pulse g4 to the fourth gate line G4 according to the fourth clock signal C4. The operations of the shift register units 415~418 and the successive shift register units are similar to those illustrated above, and are not redundantly described herein. The four clock signals C1~C4 have the same frequency. In addition, the phase difference between any two adjacent clock signals of the four clock signals C1~C4 is 90 degrees.

Please refer to FIG. 2B again. Take the first gate pulse g1 for example. The first half of the first gate pulse g1 is a pre-charge time t1, and the last half of the first gate pulse g1 is a data writing time t2. Similarly, each of the pulse signals includes a pre-charge time and a data writing time. By this operating method, the gate pulses outputted from every two gate lines neighboring the sub-pixel may be overlapped with each other for a data writing time t2. In other words, during the period of writing this data, the voltage of the sub-pixel is adversely affected by the adjacent gate line through the parasitic capacitance between the sub-pixel and the gate line. Under this circumstance, the displaying quality of the frame is deteriorated.

SUMMARY

In accordance with an aspect, the present invention provides a LCD device. The LCD device includes plural gate lines, plural data lines, and plural basic arrangement groups. Each of the basic arrangement groups includes a first row, a second row, a third row, a fourth row, a fifth row and a sixth row. The first row includes four sub-pixels corresponding to a first color. In the first row, a switching element of the first sub-pixel has a control terminal connected to the (6x+2)-th gate line, a first terminal connected to the (4y+1)-th data line, and a second terminal connected to a corresponding storage unit; a switching element of the second sub-pixel has a control terminal connected to the (6x+1)-th gate line, a first terminal connected to the (4y+3)-th data line, and a second terminal connected to a corresponding storage unit; a switching element of the third sub-pixel has a control terminal connected to the (6x+2)-th gate line, a first terminal connected to the (4y+4)-th data line, and a second terminal connected to a corresponding storage unit; a switching element of the fourth sub-pixel has a control terminal connected to the first gate line (6x+1)-th, a first terminal connected to the fourth data line (4y+4)-th, and a second terminal connected to a corresponding storage unit. The second row includes four sub-pixels corresponding to a second color. In the second row, a switching element of the first sub-pixel has a control terminal connected to the (6x+2)-th gate line, a first terminal connected to the (4y+2)-th data line, and a second terminal connected to a corresponding storage unit; a switching element of the second sub-pixel has a control terminal connected to the (6x+3)-th gate line, a first terminal connected to the second data line (4y+2)-th, and a second terminal connected to a corresponding storage unit; a switching element of the third sub-pixel has a control terminal connected to the (6x+2)-th gate line, a first terminal connected to the (4y+3)-th data line, and a second terminal connected to a corresponding storage unit; and a switching element of the fourth sub-pixel has a control terminal connected to the (6x+3)-th gate line, a first terminal connected to the (4y+5)-th data line, and a second terminal connected to a corresponding storage unit. The third row includes four sub-pixels corresponding to a third color. In the third row, a switching element of the first sub-pixel has a control terminal connected to the (6x+4)-th gate line, a first terminal connected to the (4y+1)-th data line, and a second terminal connected to a corresponding storage unit; a switching element of the second sub-pixel has a control terminal connected to the (6x+3)-th gate line, a first terminal connected to the (4y+3)-th data line, and a second terminal connected to a corresponding storage unit; a switching element of the third sub-pixel has a control terminal connected to the (6x+4)-th gate line, a first terminal connected to the (4y+4)-th data line, and a second terminal connected to a corresponding storage unit; and a switching element of the fourth sub-pixel has a control terminal connected to the (6x+3)-th gate line, a first terminal connected to the (4y+4)-th data line, and a second terminal connected to a corresponding storage unit. The fourth row includes four sub-pixels corresponding to the first color. In the fourth row, a switching element of the first sub-pixel has a control terminal connected to the (6x+4)-th gate line, a first terminal connected to the (4y+2)-th data line, and a second terminal connected to a corresponding storage unit; a switching element of the second sub-pixel has a control terminal connected to the (6x+5)-th gate line, a first terminal connected to the (4y+2)-th data line, and a second terminal connected to a corresponding storage unit; a switching element of the third sub-pixel has a control terminal connected to the (6x+4)-th gate line, a first terminal connected to the (4y+3)-th data line, and a second terminal connected to a corresponding storage unit; and a switching element of the fourth sub-pixel has a control terminal connected to the (6x+5)-th gate line, a first terminal connected to the (4y+5)-th data line, and a second terminal connected to a corresponding storage unit. The fifth row includes four sub-pixels corresponding to the second color. In the fourth row, a switching element of the first sub-pixel has a control terminal connected to the (6x+6)-th gate line, a first terminal connected to the (4y+1)-th data line, and a second terminal connected to a corresponding storage unit; a switching element of the second sub-pixel has a control terminal connected to the (6x+5)-th gate line, a first terminal connected to the (4y+3)-th data line, and a second terminal connected to a corresponding storage unit; a switching element of the third sub-pixel has a control terminal connected to the (6x+6)-th gate line, a first terminal connected to the (4y+4)-th data line, and a second terminal connected to a corresponding storage unit; and a switching element of the fourth sub-pixel has a control terminal connected to the (6x+5)-th gate line, a first terminal connected to the (4y+4)-th data line, and a second terminal connected to a corresponding storage unit. The sixth row includes four sub-pixels corresponding to the third color. In the sixth row, a switching element of the first sub-pixel has a control terminal connected to the (6x+6)-th gate line, a first terminal connected to the (4y+2)-th data line, and a second terminal connected to a corresponding storage unit; a switching element of the second sub-pixel has a control terminal connected to the (6x+7)-th gate line, a first terminal connected to the (4y+2)-th data line, and a second terminal connected to a corresponding storage unit; a switching element of the third sub-pixel has a control terminal connected to the (6x+6)-th gate line, a first terminal connected to the (4y+3)-th data line, and a second terminal connected to a corresponding storage unit; and a switching element of the fourth sub-pixel has a control terminal connected to the (6x+7)-th gate line, a first terminal connected to the (4y+5)-th data line, and a second terminal connected to a corresponding storage unit. In the above formulae, x is zero or a positive integer, and y is zero or a positive integer.

In accordance with another aspect, the present invention provides a LCD device. The LCD device includes plural gate lines, plural data lines, and plural basic arrangement groups. Each of the basic arrangement groups includes a first row, a second row, a third row, a fourth row, a fifth row and a sixth row. The first row includes four sub-pixels corresponding to a first color. In the first row, a switching element of the first sub-pixel has a control terminal connected to the (6x+1)-th gate line, a first terminal connected to the (4y+2)-th data line, and a second terminal connected to a corresponding storage unit; a switching element of the second sub-pixel has a control terminal connected to the (6x+2)-th gate line, a first terminal connected to the (4y+2)-th data line, and a second terminal connected to a corresponding storage unit; a switching element of the third sub-pixel has a control terminal connected to the (6x+1)-th gate line, a first terminal connected to the (4y+3)-th data line, and a second terminal connected to a corresponding storage unit; a switching element of the fourth sub-pixel has a control terminal connected to the first gate line (6x+2)-th, a first terminal connected to the fourth data line (4y+5)-th, and a second terminal connected to a corresponding storage unit. The second row includes four sub-pixels corresponding to a second color. In the second row, a switching element of the first sub-pixel has a control terminal connected to the (6x+3)-th gate line, a first terminal connected to the (4y+1)-th data line, and a second terminal connected to a corresponding storage unit; a switching element of the second sub-pixel has a control terminal connected to the (6x+2)-th gate line, a first terminal connected to the second data line (4y+3)-th, and a second terminal connected to a corresponding storage unit; a switching element of the third sub-pixel has a control terminal connected to the (6x+3)-th gate line, a first terminal connected to the (4y+4)-th data line, and a second terminal connected to a corresponding storage unit; and a switching element of the fourth sub-pixel has a control terminal connected to the (6x+2)-th gate line, a first terminal connected to the (4y+4)-th data line, and a second terminal connected to a corresponding storage unit. The third row includes four sub-pixels corresponding to a third color. In the third row, a switching element of the first sub-pixel has a control terminal connected to the (6x+3)-th gate line, a first terminal connected to the (4y+2)-th data line, and a second terminal connected to a corresponding storage unit; a switching element of the second sub-pixel has a control terminal connected to the (6x+4)-th gate line, a first terminal connected to the (4y+2)-th data line, and a second terminal connected to a corresponding storage unit; a switching element of the third sub-pixel has a control terminal connected to the (6x+3)-th gate line, a first terminal connected to the (4y+3)-th data line, and a second terminal connected to a corresponding storage unit; and a switching element of the fourth sub-pixel has a control terminal connected to the (6x+4)-th gate line, a first terminal connected to the (4y+5)-th data line, and a second terminal connected to a corresponding storage unit. The fourth row includes four sub-pixels corresponding to the first color. In the fourth row, a switching element of the first sub-pixel has a control terminal connected to the (6x+5)-th gate line, a first terminal connected to the (4y+1)-th data line, and a second terminal connected to a corresponding storage unit; a switching element of the second sub-pixel has a control terminal connected to the (6x+4)-th gate line, a first terminal connected to the (4y+3)-th data line, and a second terminal connected to a corresponding storage unit; a switching element of the third sub-pixel has a control terminal connected to the (6x+5)-th gate line, a first terminal connected to the (4y+4)-th data line, and a second terminal connected to a corresponding storage unit; and a switching element of the fourth sub-pixel has a control terminal connected to the (6x+4)-th gate line, a first terminal connected to the (4y+4)-th data line, and a second terminal connected to a corresponding storage unit. The fifth row includes four sub-pixels corresponding to the second color. In the fifth row, a switching element of the first sub-pixel has a control terminal connected to the (6x+5)-th gate line, a first terminal connected to the (4y+2)-th data line, and a second terminal connected to a corresponding storage unit; a switching element of the second sub-pixel has a control terminal connected to the (6x+6)-th gate line, a first terminal connected to the (4y+2)-th data line, and a second terminal connected to a corresponding storage unit; a switching element of the third sub-pixel has a control terminal connected to the (6x+5)-th gate line, a first terminal connected to the (4y+3)-th data line, and a second terminal connected to a corresponding storage unit; and a switching element of the fourth sub-pixel has a control terminal connected to the (6x+6)-th gate line, a first terminal connected to the (4y+5)-th data line, and a second terminal connected to a corresponding storage unit. The sixth row includes four sub-pixels corresponding to the third color. In the sixth row, a switching element of the first sub-pixel has a control terminal connected to the (6x+7)-th gate line, a first terminal connected to the (4y+1)-th data line, and a second terminal connected to a corresponding storage unit; a switching element of the second sub-pixel has a control terminal connected to the (6x+6)-th gate line, a first terminal connected to the (4y+3)-th data line, and a second terminal connected to a corresponding storage unit; a switching element of the third sub-pixel has a control terminal connected to the (6x+7)-th gate line, a first terminal connected to the (4y+4)-th data line, and a second terminal connected to a corresponding storage unit; and a switching element of the fourth sub-pixel has a control terminal connected to the (6x+6)-th gate line, a first terminal connected to the (4y+4)-th data line, and a second terminal connected to a corresponding storage unit. In the above formulae, x is zero or a positive integer, and y is zero or a positive integer.

In accordance with a further aspect, the present invention provides a LCD device. The LCD device includes a visible zone with plural gate lines, and a gate driver module. The gate driver module includes a gate driver and a wiring zone. The gate driver includes a (4z+1)-th shift register unit, a (4z+2)-th shift register unit, a (4z+3)-th shift register unit and a (4z+4)-th shift register unit. The (4z+1)-th shift register unit generates a (4z+1)-th gate pulse according to a first clock signal. The (4z+2)-th shift register unit generates a (4z+2)-th gate pulse according to a second clock signal. The (4z+3)-th shift register unit generates a (4z+3)-th gate pulse according to a third clock signal. The (4z+4)-th shift register unit generates a (4z+4)-th gate pulse according to a fourth clock signal. The wiring zone is used for transmitting the (4z+1)-th gate pulse to the (4z+3) gate line, transmitting the (4z+2)-th gate pulse to the (4z+1)-th gate line, transmitting the (4z+3)-th gate pulse to the (4z+4)-th gate line, transmitting the (4z+4)-th gate pulse to the (4z+2)-th gate line. In the above formulae, z is zero or a positive integer. The first clock signal, the second clock signal, the third clock signal and the fourth clock signal have the same frequency. The phase difference between any two adjacent clock signals of the first clock signal, the second clock signal, the third clock signal and the fourth clock signal is 90 degrees.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
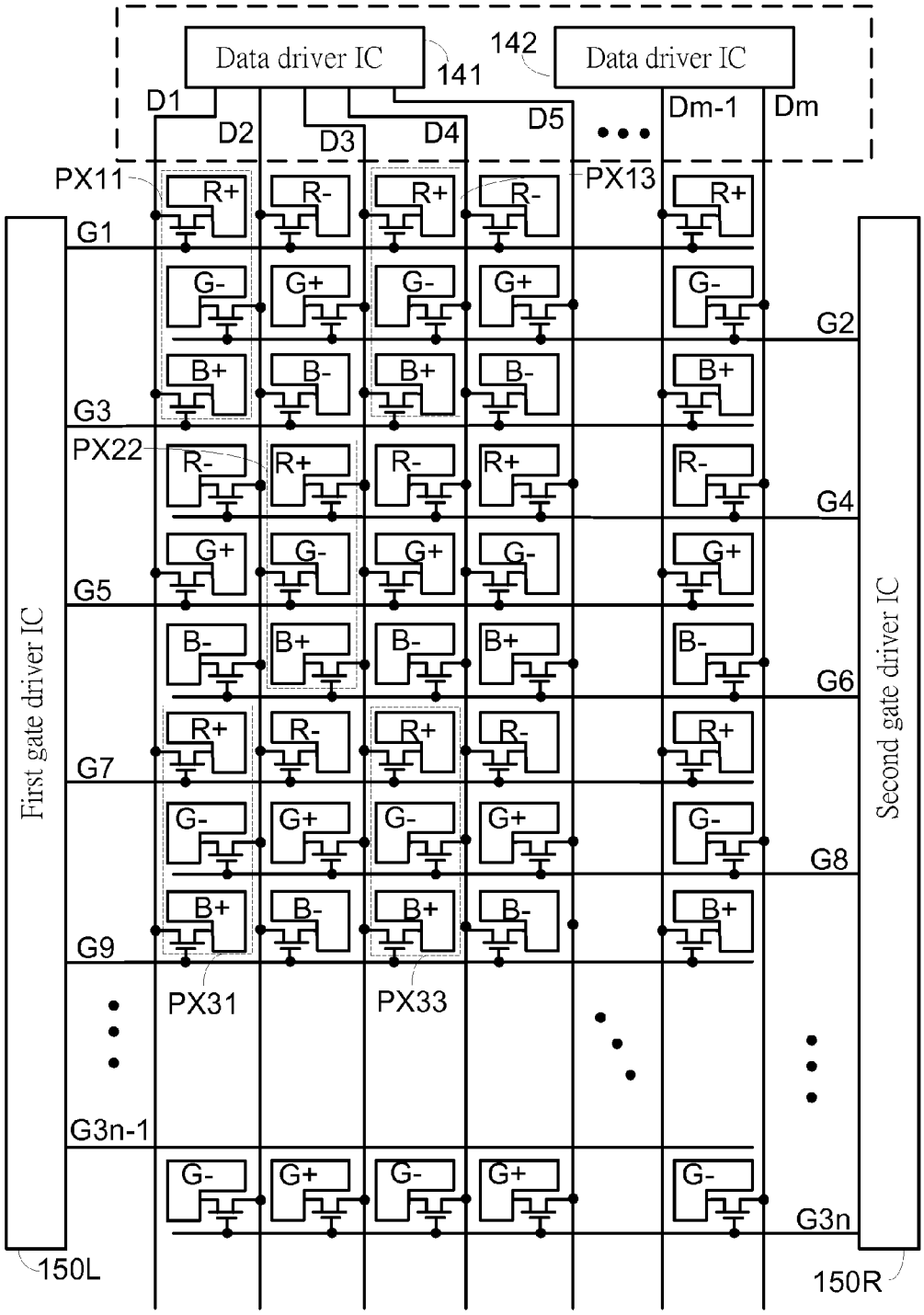
FIG.1A (Prior Art)
FIG. 1A is a schematic circuit diagram illustrating a conventional LCD panel.
Figure 1B:
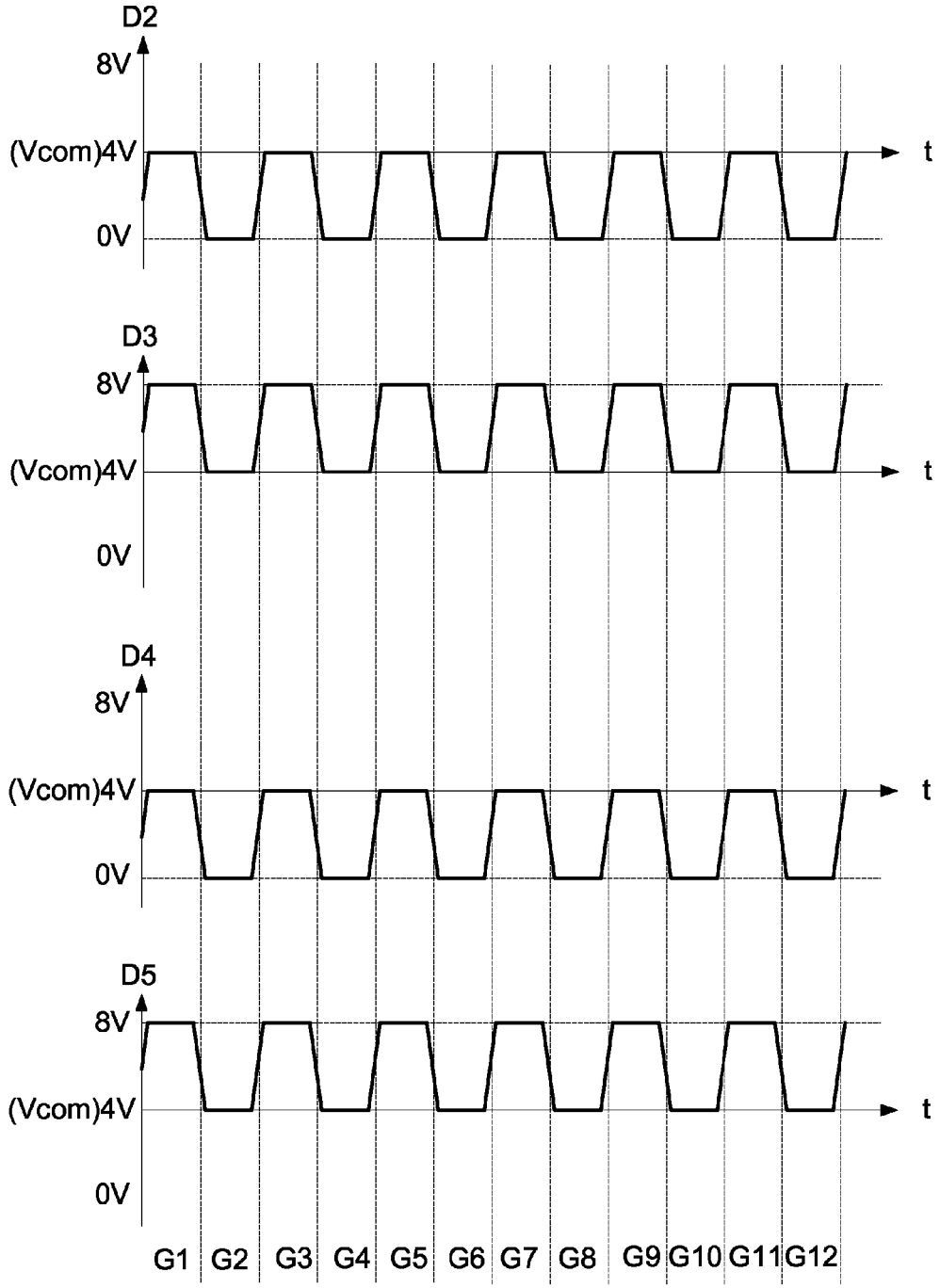
FIG.1B (Prior Art)
FIG. 1B is a schematic timing waveform diagram illustrating the signal change of the LCD panel of FIG. 1A when bright/dark vertical fringes are displayed.
Figure 2A:
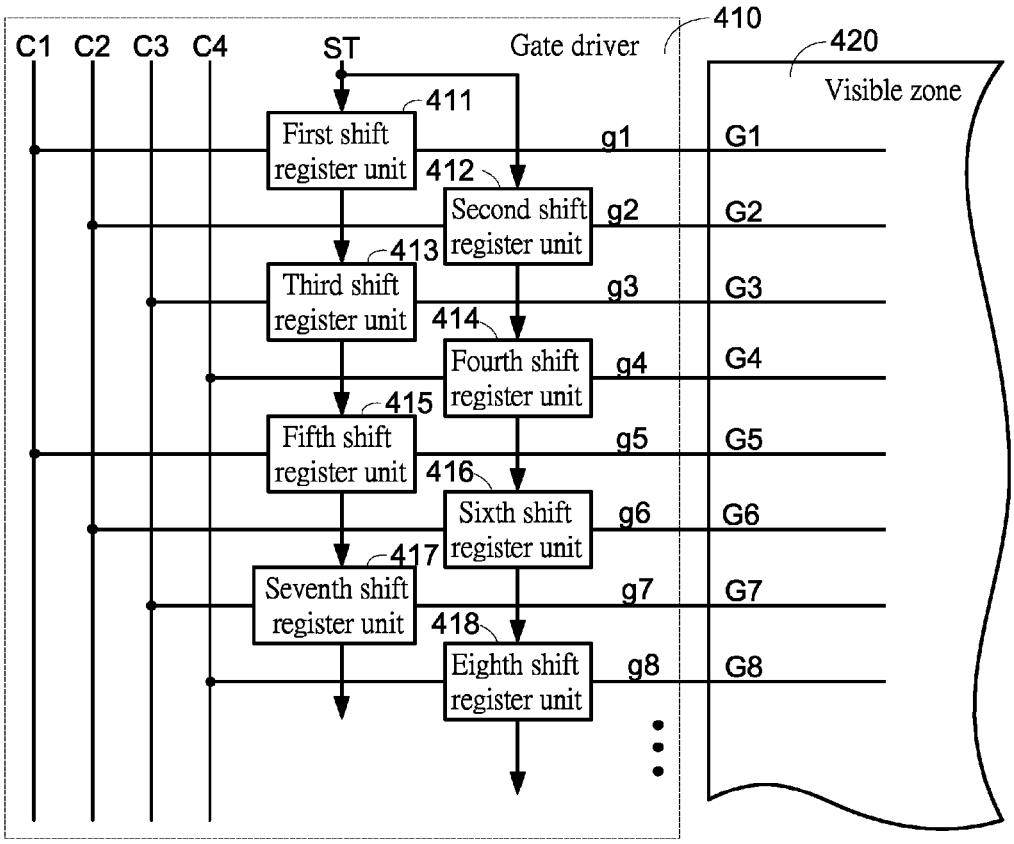
FIG.2A (Prior Art)
FIG. 2A is a schematic circuit diagram illustrating a gate driver according to the prior art.
Figure 2B:
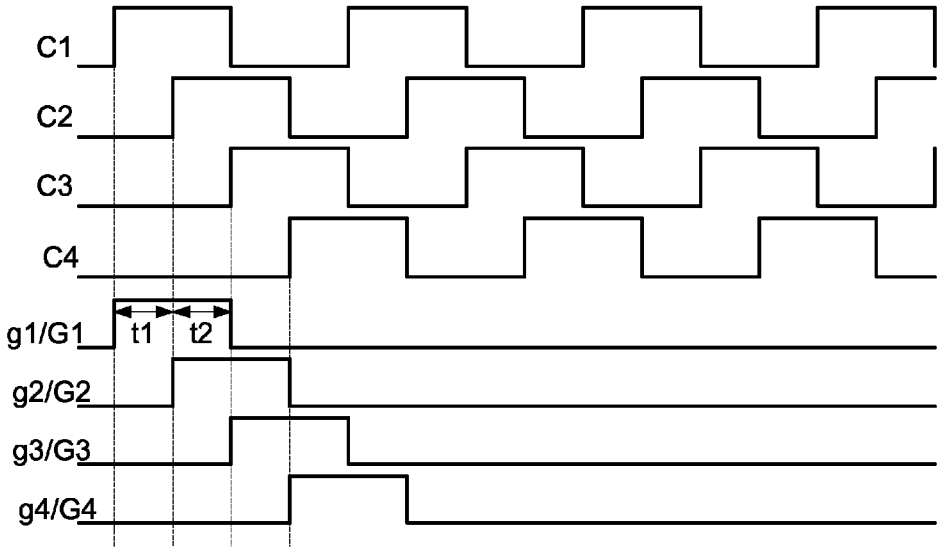
FIG. 2B is a schematic timing waveform diagram illustrating associated signals processed by the gate driver of FIG. 2A.
Figure 3A:
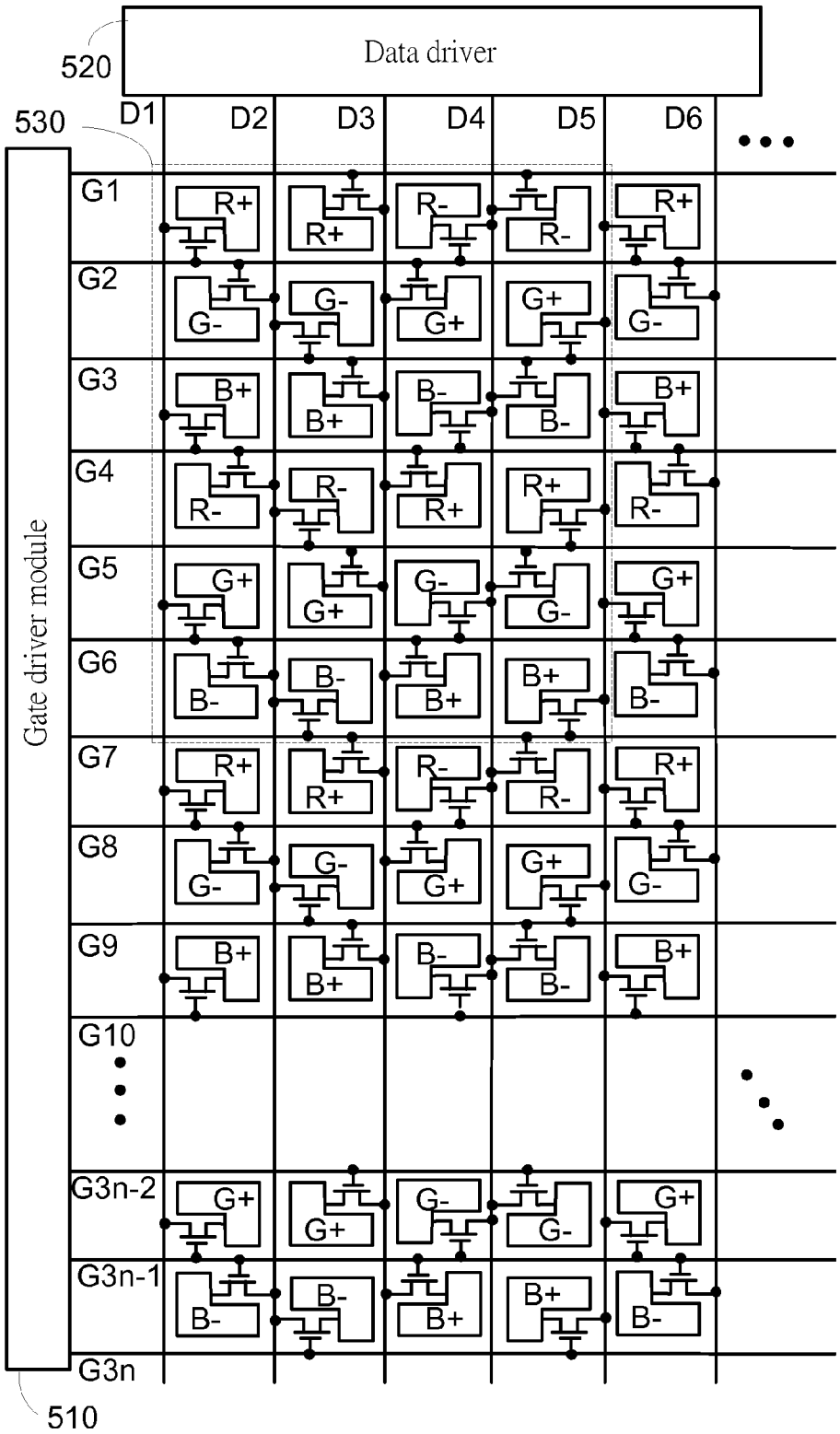
FIG. 3A is a schematic circuit diagram illustrating a conventional LCD panel according to a first embodiment of the present invention.

FIG. 3A is a schematic circuit diagram illustrating a conventional LCD panel according to a first embodiment of the present invention. The LCD panel has a tri-gate pixel configuration. As shown in FIG. 3A, the LCD panel comprises a data driver 520, a gate driver module 510 and a pixel array. The data driver 520 are connected with m data lines D1~Dm. The gate driver 510 is connected with 3n gate lines G1~G3n.

The data lines are driven by a column inversion driving method. As a result, the driving polarities of every two adjacent data lines are opposite at the same time. For example, the first data line has a positive polarity, the second data line has a negative polarity, and the rest may be deduced by analogy. A common voltage Vcom is received by the LCD panel. The data line having a voltage value higher than the common voltage has a positive polarity (+). The data line having a voltage value lower than the common voltage has a negative polarity (−).

The pixel array of the LCD panel comprises plural sub-pixels. The sub-pixels are divided into plural basic arrangement groups. In the pixel array of the first embodiment, each basic arrangement group includes 6-by-4 sub-pixels. That is, each basic arrangement group is defined by six gate lines and four data lines. For example, as shown in FIG. 3A, the basic arrangement group 530 is connected with the gate lines G1~G7 and the data lines D1~D5.

A first row of the basic arrangement group 530 comprises four red sub-pixels. The switching element of the first sub-pixel has a control terminal connected to the second gate line G2, a first terminal connected to the first data line D1, and a second terminal connected to a corresponding storage unit. The switching element of the second sub-pixel has a control terminal connected to the first gate line G1, a first terminal connected to the third data line D3, and a second terminal connected to a corresponding storage unit. The switching element of the third sub-pixel has a control terminal connected to the second gate line G2, a first terminal connected to the fourth data line D4, and a second terminal connected to a corresponding storage unit. The switching element of the fourth sub-pixel has a control terminal connected to the first gate line G1, a first terminal connected to the fourth data line D4, and a second terminal connected to a corresponding storage unit.

A second row of the basic arrangement group 530 comprises four green sub-pixels. The switching element of the first sub-pixel has a control terminal connected to the second gate line G2, a first terminal connected to the second data line D2, and a second terminal connected to a corresponding storage unit. The switching element of the second sub-pixel has a control terminal connected to the third gate line G3, a first terminal connected to the second data line D2, and a second terminal connected to a corresponding storage unit. The switching element of the third sub-pixel has a control terminal connected to the second gate line G2, a first terminal connected to the third data line D3, and a second terminal connected to a corresponding storage unit. The switching element of the fourth sub-pixel has a control terminal connected to the third gate line G3, a first terminal connected to the fifth data line D5, and a second terminal connected to a corresponding storage unit.

A third row of the basic arrangement group 530 comprises four blue sub-pixels. The switching element of the first sub-pixel has a control terminal connected to the fourth gate line G4, a first terminal connected to the first data line D1, and a second terminal connected to a corresponding storage unit. The switching element of the second sub-pixel has a control terminal connected to the third gate line G3, a first terminal connected to the third data line D3, and a second terminal connected to a corresponding storage unit. The switching element of the third sub-pixel has a control terminal connected to the fourth gate line G4, a first terminal connected to the fourth data line D4, and a second terminal connected to a corresponding storage unit. The switching element of the fourth sub-pixel has a control terminal connected to the third gate line G3, a first terminal connected to the fourth data line D4, and a second terminal connected to a corresponding storage unit.

A fourth row of the basic arrangement group 530 comprises four red sub-pixels. The switching element of the first sub-pixel has a control terminal connected to the fourth gate line G4, a first terminal connected to the second data line D2, and a second terminal connected to a corresponding storage unit. The switching element of the second sub-pixel has a control terminal connected to the fifth gate line G5, a first terminal connected to the second data line D2, and a second terminal connected to a corresponding storage unit. The switching element of the third sub-pixel has a control terminal connected to the fourth gate line G4, a first terminal connected to the third data line D3, and a second terminal connected to a corresponding storage unit. The switching element of the fourth sub-pixel has a control terminal connected to the fifth gate line G5, a first terminal connected to the fifth data line D5, and a second terminal connected to a corresponding storage unit.

A fifth row of the basic arrangement group 530 comprises four green sub-pixels. The switching element of the first sub-pixel has a control terminal connected to the sixth gate line G6, a first terminal connected to the first data line D1, and a second terminal connected to a corresponding storage unit. The switching element of the second sub-pixel has a control terminal connected to the fifth gate line G5, a first terminal connected to the third data line D3, and a second terminal connected to a corresponding storage unit. The switching element of the third sub-pixel has a control terminal connected to the sixth gate line G6, a first terminal connected to the fourth data line D4, and a second terminal connected to a corresponding storage unit. The switching element of the fourth sub-pixel has a control terminal connected to the fifth gate line G5, a first terminal connected to the fourth data line D4, and a second terminal connected to a corresponding storage unit.

A sixth row of the basic arrangement group 530 comprises four blue sub-pixels. The switching element of the first sub-pixel has a control terminal connected to the sixth gate line G6, a first terminal connected to the second data line D2, and a second terminal connected to a corresponding storage unit. The switching element of the second sub-pixel has a control terminal connected to the seventh gate line G7, a first terminal connected to the second data line D2, and a second terminal connected to a corresponding storage unit. The switching element of the third sub-pixel has a control terminal connected to the sixth gate line G6, a first terminal connected to the third data line D3, and a second terminal connected to a corresponding storage unit. The switching element of the fourth sub-pixel has a control terminal connected to the seventh gate line G7, a first terminal connected to the fifth data line D5, and a second terminal connected to a corresponding storage unit.

The basic arrangement group 530 is defined by the gate lines G1~G7 and the data lines D1~D5. Nevertheless, each basic arrangement group of the pixel array may be defined by the (6x+1)-th gate line to the (6x+7)-th gate line and the (4y+1)-th data line to the (4y+5)-th data line, where x is zero or a positive integer, and y is zero or a positive integer.

In a case that x=y=0, the basic arrangement group 530 is defined by the gate lines G1~G7 and the data lines D1~D5. In a case that x=1 and y=0, the basic arrangement group is defined by the gate lines G7~G13 and the data lines D1~D5.

During the process of displaying regular frames, the way of arranging the sub-pixels of the LCD panel of FIG. 3A can obviate the drawbacks encountered from the prior art. Since the voltages of the adjacent data lines are no longer simultaneously changed from a low-level state to a high-level state or simultaneously changed from the high-level state to the low-level state, the common voltage Vcom will not be deviated from the original level because of a coupling effect. Under this circumstance, the frame can be normally displayed.

Figure 3B:
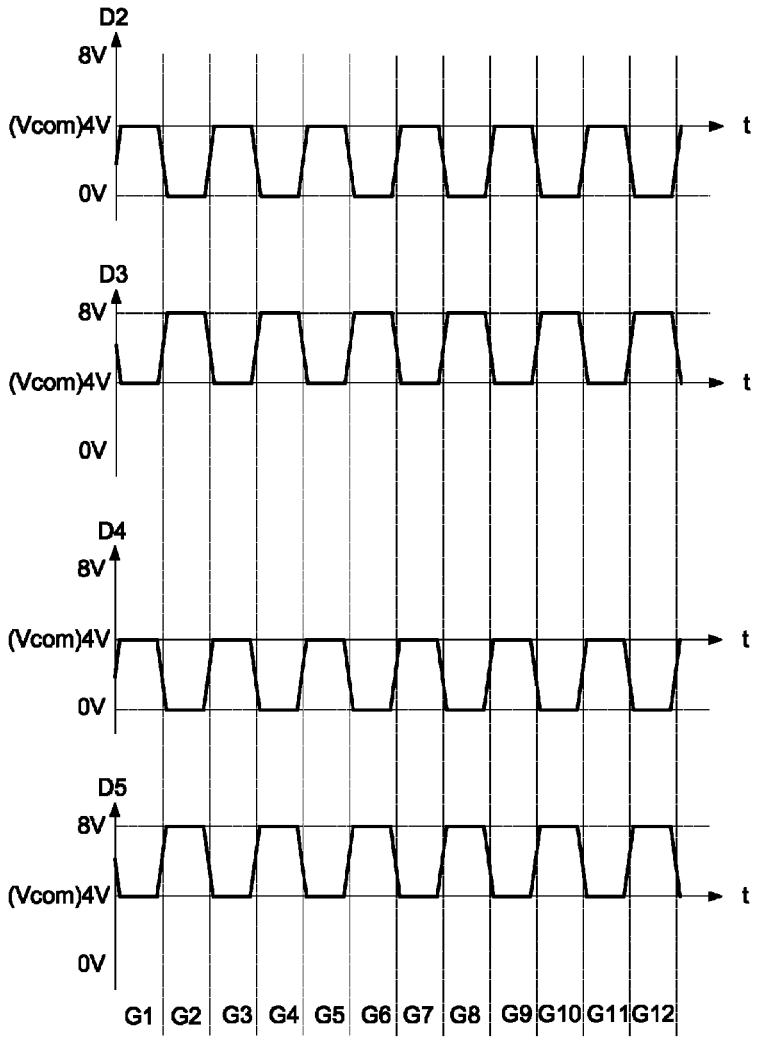
FIG. 3B is a schematic timing waveform diagram illustrating the signal change of the LCD panel of FIG. 3A when bright/dark vertical fringes are displayed.

FIG. 3B is a schematic timing waveform diagram illustrating the signal change of the LCD panel of FIG. 3A when bright/dark vertical fringes are displayed. The common voltage Vcom is 4 volts. The even-numbered data lines have the negative polarity. The odd-numbered data lines have the positive polarity. If the voltage value of the data line is equal to the common voltage Vcom, the sub-pixels corresponding to the data line are in the full-bright state. Whereas, if the voltage value of the data line is equal to 0V or 8V, the sub-pixels corresponding to the data line are in the full-dark state.

Obviously, in a case that the data lines of the LCD panel are driven by a column inversion driving method to display the bright/dark vertical fringes, the voltage of the even-numbered data lines (e.g. the second data line D2 and the fourth data line D4) are alternately changed between 4V and 0V in response to the gate pulses (G1~G12) of the gate lines. Similarly, the voltage of the odd-numbered data lines (e.g. the third data line D3 and the fifth data line D5) are alternately changed between 8V and 4V in response to the gate pulses (G1~G12) of the gate lines. In such way, the bright/dark vertical fringes are shown on the frame.

As can be seen from FIG. 3B, when the voltages of the even-numbered data lines are changed from a low-level state to a high-level state, the voltages of the odd-numbered data lines are changed from the high-level state to the low-level state. Whereas, when the voltages of the even-numbered data lines are changed from the high-level state to the low-level state, the voltages of the odd-numbered data lines are changed from the low-level state to the high-level state. As a result, the common voltage Vcom will not be deviated from the original level because of a coupling effect. Under this circumstance, the frame can be normally displayed.

Figure 4A:
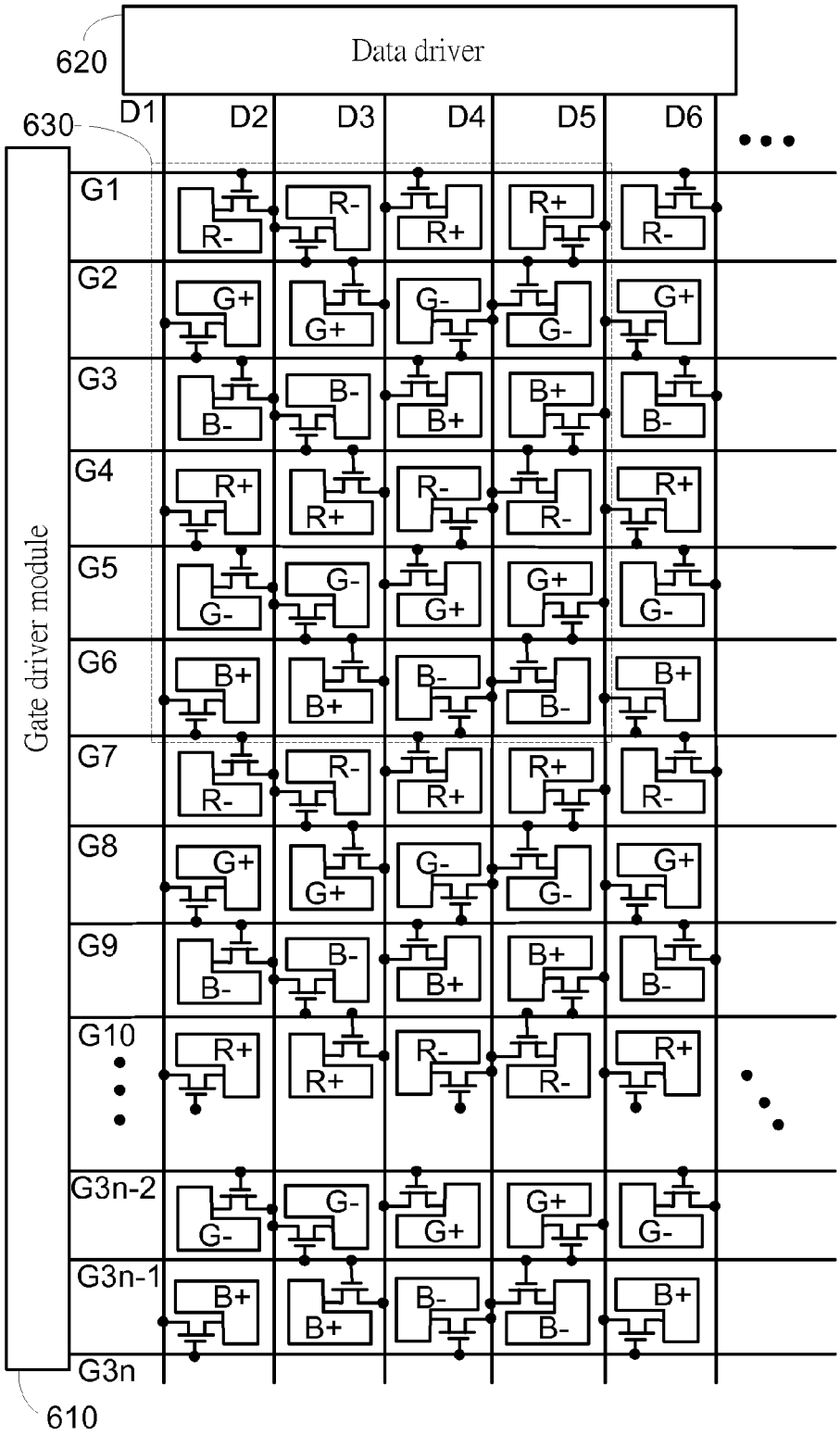
FIG. 4A is a schematic circuit diagram illustrating a conventional LCD panel according to a second embodiment of the present invention.

FIG. 4A is a schematic circuit diagram illustrating a conventional LCD panel according to a second embodiment of the present invention. The LCD panel has a tri-gate pixel configuration. As shown in FIG. 4A, the LCD panel comprises a data driver 620, a gate driver module 610 and a pixel array. The data driver 620 are connected with m data lines D1~Dm. The gate driver 610 is connected with 3n gate lines G1~G3n.

The data lines are driven by a column inversion driving method. As a result, the driving polarities of every two adjacent data lines are opposite at the same time. For example, the first data line has a positive polarity, the second data line has a negative polarity, and the rest may be deduced by analogy. A common voltage Vcom is received by the LCD panel. The data line having a voltage value higher than the common voltage has a positive polarity (+). The data line having a voltage value lower than the common voltage has a negative polarity (−).

In the pixel array of the second embodiment, each basic arrangement group includes 6-by-4 sub-pixels. That is, each basic arrangement group is defined by six gate lines and four data lines. For example, as shown in FIG. 4A, the basic arrangement group 630 is connected with the gate lines G1~G7 and the data lines D1~D5.

A first row of the basic arrangement group 630 comprises four red sub-pixels. The switching element of the first sub-pixel has a control terminal connected to the first gate line G1, a first terminal connected to the second data line D2, and a second terminal connected to a corresponding storage unit. The switching element of the second sub-pixel has a control terminal connected to the second gate line G2, a first terminal connected to the second data line D2, and a second terminal connected to a corresponding storage unit. The switching element of the third sub-pixel has a control terminal connected to the first gate line G1, a first terminal connected to the third data line D3, and a second terminal connected to a corresponding storage unit. The switching element of the fourth sub-pixel has a control terminal connected to the second gate line G2, a first terminal connected to the fifth data line D5, and a second terminal connected to a corresponding storage unit.

A second row of the basic arrangement group 630 comprises four green sub-pixels. The switching element of the first sub-pixel has a control terminal connected to the third gate line G3, a first terminal connected to the first data line D1, and a second terminal connected to a corresponding storage unit. The switching element of the second sub-pixel has a control terminal connected to the second gate line G2, a first terminal connected to the third data line D3, and a second terminal connected to a corresponding storage unit. The switching element of the third sub-pixel has a control terminal connected to the third gate line G3, a first terminal connected to the fourth data line D4, and a second terminal connected to a corresponding storage unit. The switching element of the fourth sub-pixel has a control terminal connected to the second gate line G2, a first terminal connected to the fourth data line D4, and a second terminal connected to a corresponding storage unit.

A third row of the basic arrangement group 630 comprises four blue sub-pixels. The switching element of the first sub-pixel has a control terminal connected to the third gate line G3, a first terminal connected to the second data line D2, and a second terminal connected to a corresponding storage unit. The switching element of the second sub-pixel has a control terminal connected to the fourth gate line G4, a first terminal connected to the second data line D2, and a second terminal connected to a corresponding storage unit. The switching element of the third sub-pixel has a control terminal connected to the third gate line G3, a first terminal connected to the third data line D3, and a second terminal connected to a corresponding storage unit. The switching element of the fourth sub-pixel has a control terminal connected to the fourth gate line G4, a first terminal connected to the fifth data line D5, and a second terminal connected to a corresponding storage unit.

A fourth row of the basic arrangement group 630 comprises four red sub-pixels. The switching element of the first sub-pixel has a control terminal connected to the fifth gate line G5, a first terminal connected to the first data line D1, and a second terminal connected to a corresponding storage unit. The switching element of the second sub-pixel has a control terminal connected to the fourth gate line G4, a first terminal connected to the third data line D3, and a second terminal connected to a corresponding storage unit. The switching element of the third sub-pixel has a control terminal connected to the fifth gate line G5, a first terminal connected to the fourth data line D4, and a second terminal connected to a corresponding storage unit. The switching element of the fourth sub-pixel has a control terminal connected to the fourth gate line G4, a first terminal connected to the fourth data line D4, and a second terminal connected to a corresponding storage unit.

A fifth row of the basic arrangement group 630 comprises four green sub-pixels. The switching element of the first sub-pixel has a control terminal connected to the fifth gate line G5, a first terminal connected to the second data line D2, and a second terminal connected to a corresponding storage unit. The switching element of the second sub-pixel has a control terminal connected to the sixth gate line G6, a first terminal connected to the second data line D2, and a second terminal connected to a corresponding storage unit. The switching element of the third sub-pixel has a control terminal connected to the fifth gate line G5, a first terminal connected to the third data line D3, and a second terminal connected to a corresponding storage unit. The switching element of the fourth sub-pixel has a control terminal connected to the sixth gate line G6, a first terminal connected to the fifth data line D5, and a second terminal connected to a corresponding storage unit.

A sixth row of the basic arrangement group 630 comprises four blue sub-pixels. The switching element of the first sub-pixel has a control terminal connected to the seventh gate line G7, a first terminal connected to the first data line D1, and a second terminal connected to a corresponding storage unit. The switching element of the second sub-pixel has a control terminal connected to the sixth gate line G6, a first terminal connected to the third data line D3, and a second terminal connected to a corresponding storage unit. The switching element of the third sub-pixel has a control terminal connected to the seventh gate line G7, a first terminal connected to the fourth data line D4, and a second terminal connected to a corresponding storage unit. The switching element of the fourth sub-pixel has a control terminal connected to the sixth gate line G4, a first terminal connected to the fourth data line D4, and a second terminal connected to a corresponding storage unit.

The basic arrangement group 630 is defined by the gate lines G1~G7 and the data lines D1~D5. Nevertheless, each basic arrangement group of the pixel array may be defined by the (6x+1)-th gate line to the (6x+7)-th gate line and the (4y+1)-th data line to the (4y+5)-th data line, where x is zero or a positive integer, and y is zero or a positive integer.

In a case that x=y=0, the basic arrangement group 530 is defined by the gate lines G1~G7 and the data lines D1~D5. In a case that x=1 and y=0, the basic arrangement group is defined by the gate lines G7~G13 and the data lines D1~D5.

During the process of displaying regular frames, the way of arranging the sub-pixels of the LCD panel of FIG. 4A can obviate the drawbacks encountered from the prior art. Since the voltages of the adjacent data lines are no longer simultaneously changed from a low-level state to a high-level state or simultaneously changed from the high-level state to the low-level state, the common voltage Vcom will not be deviated from the original level because of a coupling effect. Under this circumstance, the frame can be normally displayed.

Figure 4B:
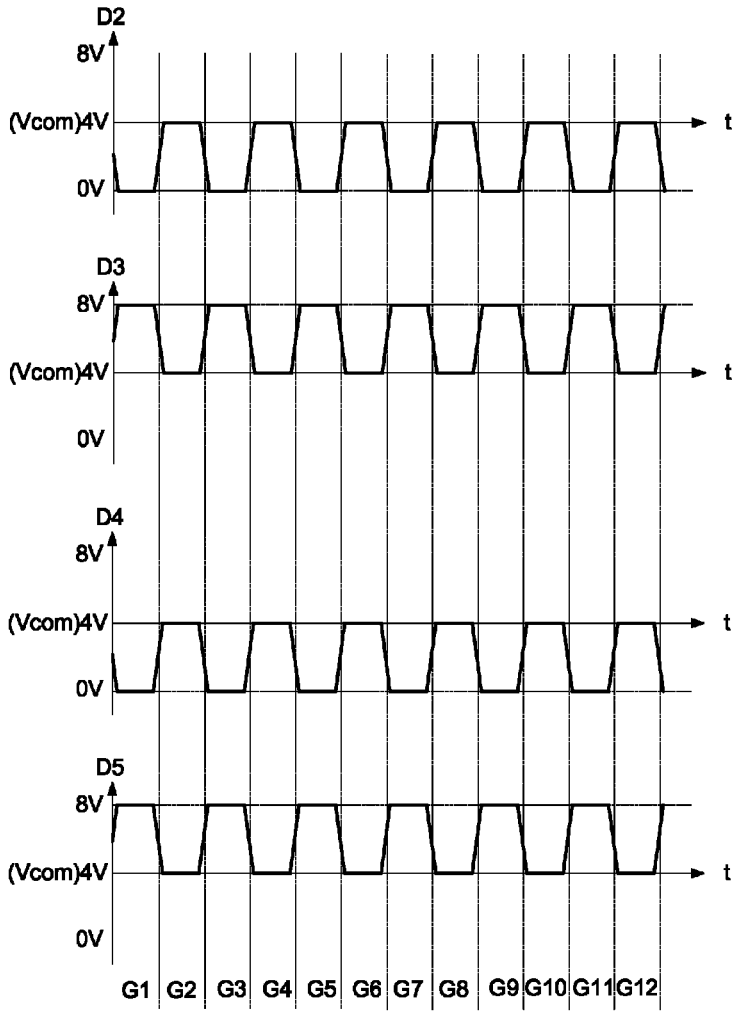
FIG. 4B is a schematic timing waveform diagram illustrating the signal change of the LCD panel of FIG. 4A when bright/dark vertical fringes are displayed.

FIG. 4B is a schematic timing waveform diagram illustrating the signal change of the LCD panel of FIG. 4A when bright/dark vertical fringes are displayed. The common voltage Vcom is 4 volts. The even-numbered data lines have the negative polarity. The odd-numbered data lines have the positive polarity. If the voltage value of the data line is equal to the common voltage Vcom, the sub-pixels corresponding to the data line are in the full-bright state. Whereas, if the voltage value of the data line is equal to 0V or 8V, the sub-pixels corresponding to the data line are in the full-dark state.

Obviously, in a case that the data lines of the LCD panel are driven by a column inversion driving method to display the bright/dark vertical fringes, the voltage of the even-numbered data lines (e.g. the second data line D2 and the fourth data line D4) are alternately changed between 4V and 0V in response to the gate pulses (G1~G12) of the gate lines. Similarly, the voltage of the odd-numbered data lines (e.g. the third data line D3 and the fifth data line D5) are alternately changed between 8V and 4V in response to the gate pulses (G1~G12) of the gate lines. In such way, the bright/dark vertical fringes are shown on the frame.

As can be seen from FIG. 4B, when the voltages of the even-numbered data lines are changed from a low-level state to a high-level state, the voltages of the odd-numbered data lines are changed from the high-level state to the low-level state. Whereas, when the voltages of the even-numbered data lines are changed from the high-level state to the low-level state, the voltages of the odd-numbered data lines are changed from the low-level state to the high-level state. As a result, the common voltage Vcom will not be deviated from the original level because of a coupling effect. Under this circumstance, the frame can be normally displayed.

In accordance with the present invention, the gate driver module is specially designed to enhance the displaying quality of the LCD by cross-connecting the layout traces of the wiring zone in a specified manner. By means of the gate driver module, every two adjacent gate lines of the visible zone are no longer overlapped with each other. Since the voltage of the sub-pixel is not adversely affected by the adjacent gate lines, the displaying quality of the frame is enhanced.

Figure 5A:
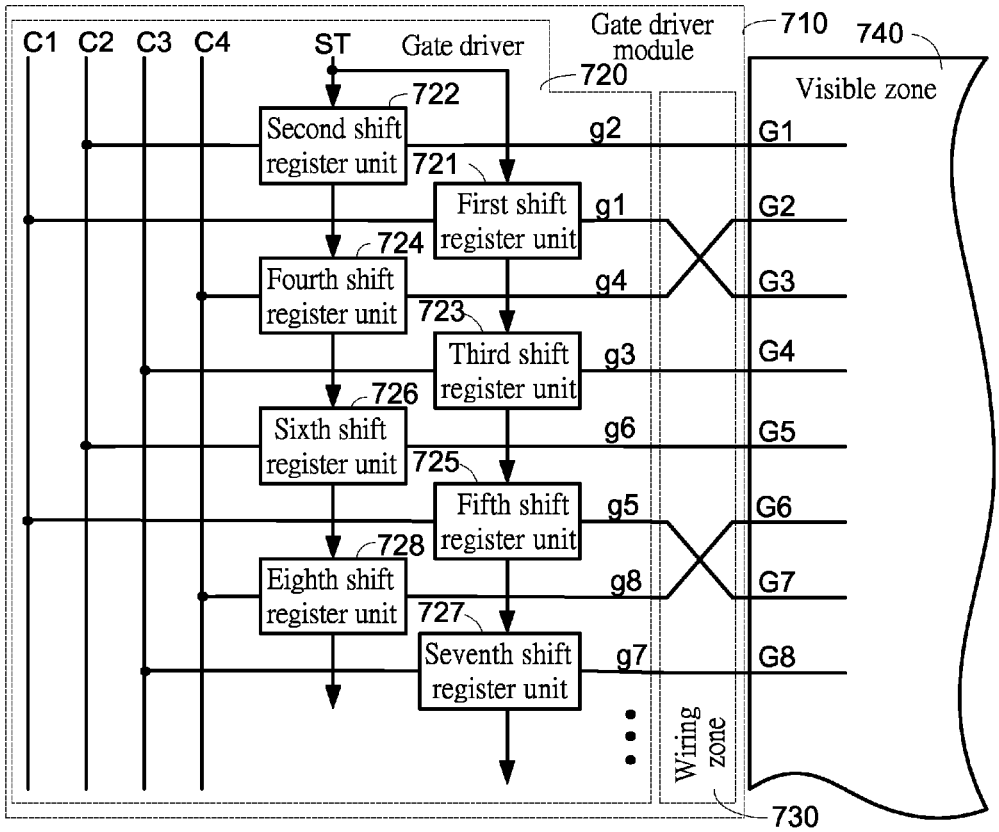
FIG. 5A is a schematic circuit diagram illustrating a gate driver module according to an embodiment of the present invention.
Figure 5B:
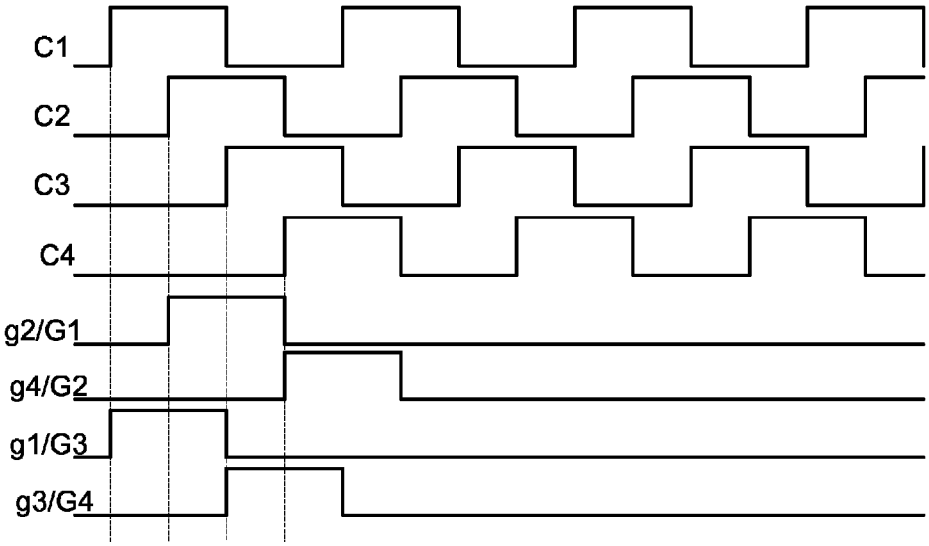
FIG. 5B is a schematic timing waveform diagram illustrating associated signals processed by the gate driver module of FIG. 5A.

Please refer to FIGS. 5A and 5B. FIG. 5A is a schematic circuit diagram illustrating a gate driver module according to an embodiment of the present invention. FIG. 5B is a schematic timing waveform diagram illustrating associated signals processed by the gate driver module of FIG. 5A. The gate driver module 710 comprises a gate driver 720 and a wiring zone 730. The gate driver 720 comprises plural shift register units 721~728. According to four clock signals C1~C4, the shift register units 721~724 generate four gate pulses g1~g4, respectively. The visible zone 740 includes plural gate lines G1~G8. Through the wiring zone 730, the first gate pulse g1 is transmitted to the third gate line G3, the second gate pulse g2 is transmitted to the first gate line G1, the third gate pulse g3 is transmitted to the fourth gate line G4, and the fourth gate pulse g4 is transmitted to the second gate line G2. The wiring relationships between the shift register units 725~728 are similar to the wiring relationships between the shift register units 721~724, and are not redundantly described herein.

In response to a start signal ST, the first shift register unit 721 and the second shift register unit 722 issue the first gate pulse g1 and the second gate pulse g2 to the third gate line G3 and the first gate line G1 according to the first clock signal C1 and the second clock signal C2, respectively. The third shift register unit 723 is informed by the first shift register unit 721 to issue the third gate pulse g3 to the fourth gate line G4 according to the third clock signal C3. The fourth shift register unit 724 is informed by the second shift register unit 722 to issue the fourth gate pulse g4 to the second gate line G2 according to the fourth clock signal C4. The four clock signals C1~C4 have the same frequency. In addition, the phase difference between any two adjacent clock signals of the four clock signals C1~C4 is 90 degrees.

Please refer to FIG. 5B again. After being processed by the wiring zone 730, the second gate pulse g2 on the first gate line G1 and the fourth gate pulse g4 on the second gate line G2 are not overlapped with each other. Similarly, the first gate pulse g1 on the third clock signal C3 and the third gate pulse g3 on the fourth gate line G4 are not overlapped with each other. In such way, the gate pulses outputted from every two gate lines neighboring the sub-pixel are not overlapped with each other, so that the frame can be normally displayed.

In other word, the gate driver 720 comprises a (4z+1)-th shift register unit, a (4z+2)-th shift register unit, a (4z+3)-th shift register unit and a (4z+4)-th shift register unit. According to a first clock signal, the (4z+1)-th shift register unit generates a (4z+1)-th gate pulse. According to a second clock signal, the (4z+2)-th shift register unit generates a (4z+2)-th gate pulse. According to a third clock signal, the (4z+3)-th shift register unit generates a (4z+3)-th gate pulse. According to a fourth clock signal, the (4z+4)-th shift register unit generates a (4z+4)-th gate pulse. By the wiring zone, the (4z+1)-th gate pulse is transmitted to a (4z+3)-th gate line, the (4z+2)-th gate pulse is transmitted to a (4z+1)-th gate line, the (4z+3)-th gate pulse is transmitted to a (4z+4)-th gate line, and the (4z+4)-th gate pulse is transmitted to a (4z+2)-th gate line. In the above formulae, z is zero or a positive integer.

Figure 6A:
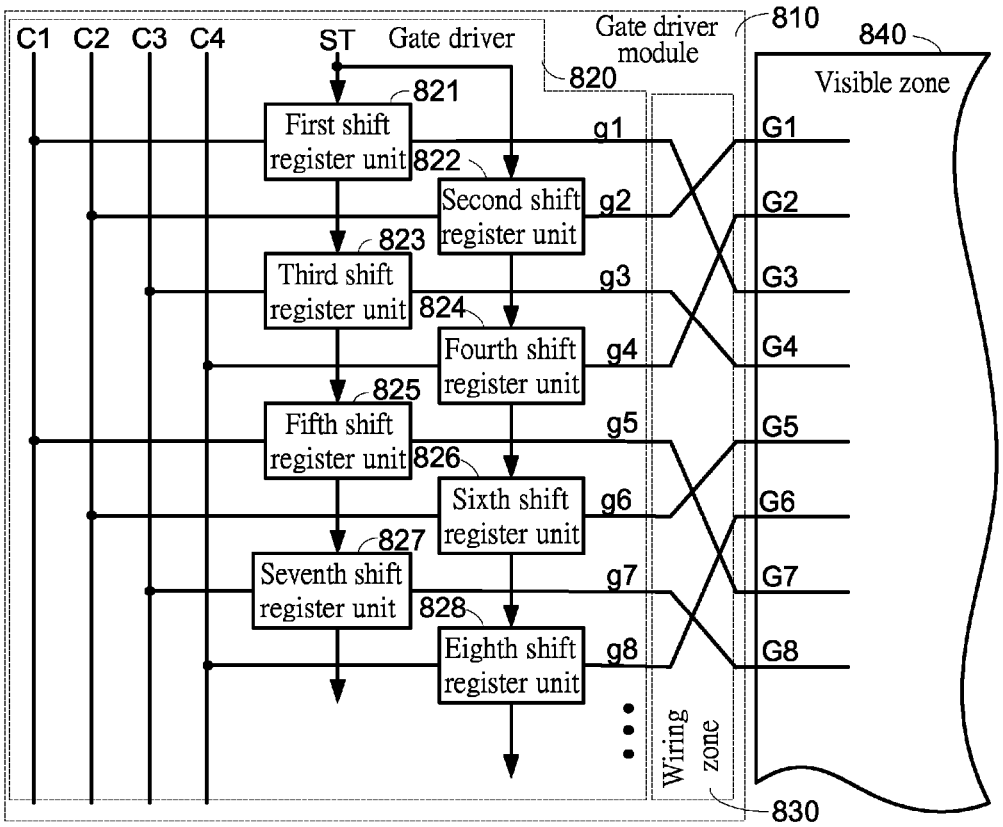
FIG. 6A is a schematic circuit diagram illustrating a gate driver module according to another embodiment of the present invention.
Figure 6B:
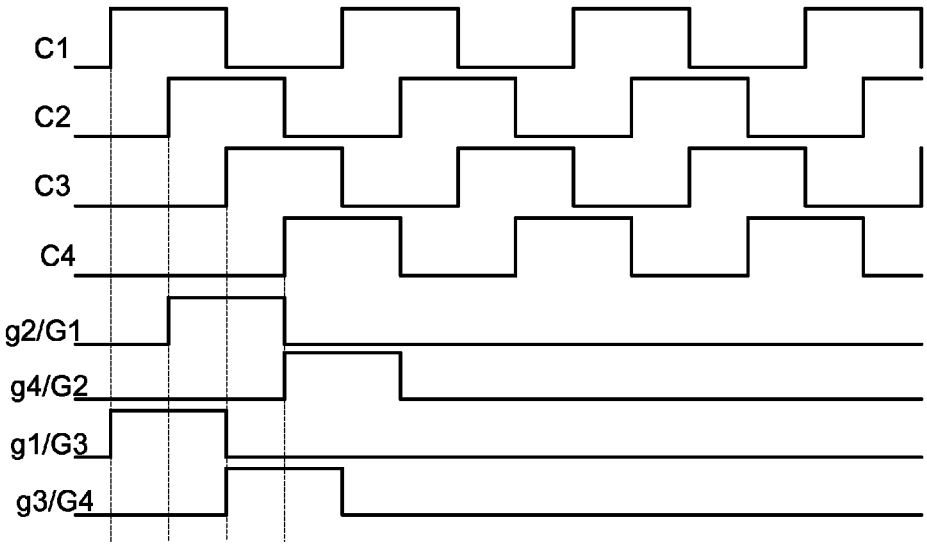
FIG. 6B is a schematic timing waveform diagram illustrating associated signals processed by the gate driver module of FIG. 6A.

Please refer to FIGS. 6A and 6B. FIG. 6A is a schematic circuit diagram illustrating a gate driver module according to another embodiment of the present invention. FIG. 6B is a schematic timing waveform diagram illustrating associated signals processed by the gate driver module of FIG. 6A. The gate driver module 810 comprises a gate driver 820 and a wiring zone 830. The gate driver 820 comprises plural shift register units 821~828. According to four clock signals C1~C4, the shift register units 821~824 generate four gate pulses g1~g4, respectively. The visible zone 840 includes plural gate lines G1~G8. Through the wiring zone 830, the first gate pulse g1 is transmitted to the third gate line G3, the second gate pulse g2 is transmitted to the first gate line G1, the third gate pulse g3 is transmitted to the fourth gate line G4, and the fourth gate pulse g4 is transmitted to the second gate line G2. The wiring relationships between the shift register units 825~828 are similar to the wiring relationships between the shift register units 821~824, and are not redundantly described herein.

In response to a start signal ST, the first shift register unit 821 and the second shift register unit 822 issue the first gate pulse g1 and the second gate pulse g2 to the third gate line G3 and the first gate line G1 according to the first clock signal C1 and the second clock signal C2, respectively. The third shift register unit 823 is informed by the first shift register unit 821 to issue the third gate pulse g3 to the fourth gate line G4 according to the third clock signal C3. The fourth shift register unit 824 is informed by the second shift register unit 822 to issue the fourth gate pulse g4 to the second gate line G2 according to the fourth clock signal C4. The four clock signals C1~C4 have the same frequency. In addition, the phase difference between any two adjacent clock signals of the four clock signals C1~C4 is 90 degrees.

Please refer to FIG. 6B again. After being processed by the wiring zone 830, the second gate pulse g2 on the first gate line G1 and the fourth gate pulse g4 on the second gate line G2 are not overlapped with each other. Similarly, the first gate pulse g1 on the third clock signal C3 and the third gate pulse g3 on the fourth gate line G4 are not overlapped with each other. In such way, the gate pulses outputted from every two gate lines neighboring the sub-pixel are not overlapped with each other, so that the frame can be normally displayed.

From the above description, the present invention provides a LCD panel with an improved pixel array configuration for using a column inversion driving method to drive the data lines and achieving a stable common voltage Vcom. Moreover, by cross-connecting the layout traces of the wiring zone in a specified manner, the gate pulses outputted from every two gate lines neighboring the sub-pixel are not overlapped with each other, so that the frame can be normally displayed.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A liquid crystal display (LCD) panel, comprising:

plural gate lines;

plural data lines; and plural basic arrangement groups, wherein each of the basic arrangement groups comprises:

a first row comprising a first sub-pixel, a second sub-pixel, a third sub-pixel, and a fourth sub-pixel corresponding to a first color, wherein a switching element of the first sub-pixel has a control terminal directly connected to the (6x+2)-th gate line, a first terminal directly connected to the (4y+1)-th data line, and a second terminal directly connected to a corresponding storage unit; a switching element of the second sub-pixel has a control terminal directly connected to the (6x+1)-th gate line, a first terminal directly connected to the (4y+3)-th data line, and a second terminal directly connected to a corresponding storage unit; a switching element of the third sub-pixel has a control terminal directly connected to the (6x+2)-th gate line, a first terminal directly connected to the (4y+4)-th data line, and a second terminal directly connected to a corresponding storage unit; a switching element of the fourth sub-pixel has a control terminal directly connected to the first gate line (6x+1)-th, a first terminal directly connected to the fourth data line (4y+4)-th, and a second terminal directly connected to a corresponding storage unit;

a second row comprising a fifth sub-pixel, a sixth sub-pixel, a seventh sub-pixel, and an eighth sub-pixel corresponding to a second color, wherein a switching element of the fifth sub-pixel has a control terminal directly connected to the (6x+2)-th gate line, a first terminal directly connected to the (4y+2)-th data line, and a second terminal directly connected to a corresponding storage unit; a switching element of the sixth sub-pixel has a control terminal directly connected to the (6x+3)-th gate line, a first terminal directly connected to the second data line (4y+2)-th, and a second terminal directly connected to a corresponding storage unit; a switching element of the seventh sub-pixel has a control terminal directly connected to the (6x+2)-th gate line, a first terminal directly connected to the (4y+3)-th data line, and a second terminal directly connected to a corresponding storage unit; and a switching element of the eighth sub-pixel has a control terminal directly connected to the (6x+3)-th gate line, a first terminal directly connected to the (4y+5)-th data line, and a second terminal directly connected to a corresponding storage unit;

a third row comprising a ninth sub-pixel, a tenth sub pixel, an eleventh sub-pixel, and a twelfth sub-pixel corresponding to a third color, wherein a switching element of the ninth sub-pixel has a control terminal directly connected to the (6x+4)-th gate line, a first terminal directly connected to the (4y+1)-th data line, and a second terminal directly connected to a corresponding storage unit; a switching element of the tenth sub-pixel has a control terminal directly connected to the (6x+3)-th gate line, a first terminal directly connected to the (4y+3)-th data line, and a second terminal directly connected to a corresponding storage unit; a switching element of the eleventh sub-pixel has a control terminal directly connected to the (6x+4)-th gate line, a first terminal directly connected to the (4y+4)-th data line, and a second terminal directly connected to a corresponding storage unit; and a switching element of the twelfth sub-pixel has a control terminal directly connected to the (6x+3)-th gate line, a first terminal directly connected to the (4y+4)-th data line, and a second terminal directly connected to a corresponding storage unit;

a fourth row comprising a thirteenth sub-pixel, a fourteenth sub-pixel, a fifteenth sub-pixel, and a sixteenth sub-pixel corresponding to the first color, wherein a switching element of the thirteenth sub-pixel has a control terminal directly connected to the (6x+4)-th gate line, a first terminal directly connected to the (4y+2)-th data line, and a second terminal directly connected to a corresponding storage unit; a switching element of the fourteenth sub-pixel has a control terminal directly connected to the (6x+5)-th gate line, a first terminal directly connected to the (4y+2)-th data line, and a second terminal directly connected to a corresponding storage unit; a switching element of the fifteenth sub-pixel has a control terminal directly connected to the (6x+4)-th gate line, a first terminal directly connected to the (4y+3)-th data line, and a second terminal directly connected to a corresponding storage unit; and a switching element of the sixteenth sub-pixel has a control terminal directly connected to the (6x+5)-th gate line, a first terminal directly connected to the (4y+5)-th data line, and a second terminal directly connected to a corresponding storage unit;

a fifth row comprising a seventeenth sub-pixel, an eighteenth sub-pixel, a nineteenth sub-pixel, and a twentieth sub-pixel corresponding to the second color, wherein a switching element of the seventeenth sub-pixel has a control terminal directly connected to the (6x+6)-th gate line, a first terminal directly connected to the (4y+1)-th data line, and a second terminal directly connected to a corresponding storage unit; a switching element of the eighteenth sub-pixel has a control terminal directly connected to the (6x+5)-th gate line, a first terminal directly connected to the (4y+3)-th data line, and a second terminal directly connected to a corresponding storage unit; a switching element of the nineteenth sub-pixel has a control terminal directly connected to the (6x+6)-th gate line, a first terminal directly connected to the (4y+4)-th data line, and a second terminal directly connected to a corresponding storage unit; and a switching element of the twentieth sub-pixel has a control terminal directly connected to the (6x+5)-th gate line, a first terminal directly connected to the (4y+4)-th data line, and a second terminal directly connected to a corresponding storage unit; and a sixth row comprising a twenty-first sub-pixel, a twenty-second sub-pixel, a twenty-third sub-pixel, and a twenty-fourth sub-pixel corresponding to the third color, wherein a switching element of the twenty-first sub-pixel has a control terminal directly connected to the (6x+6)-th gate line, a first terminal directly connected to the (4y+2)-th data line, and a second terminal directly connected to a corresponding storage unit; a switching element of the twenty-second sub-pixel has a control terminal directly connected to the (6x+7)-th gate line, a first terminal directly connected to the (4y+2)-th data line, and a second terminal directly connected to a corresponding storage unit; a switching element of the twenty-third sub-pixel has a control terminal directly connected to the (6x+6)-th gate line, a first terminal directly connected to the (4y+3)-th data line, and a second terminal directly connected to a corresponding storage unit; and a switching element of the twenty-fourth sub-pixel has a control terminal directly connected to the (6x+7)-th gate line, a first terminal directly connected to the (4y+5)-th data line, and a second terminal directly connected to a corresponding storage unit, wherein x is zero or a positive integer, and y is zero or a positive integer.

2. The liquid crystal display panel according to claim 1, wherein the first color is a red color, the second color is a green color, and the third color is a blue color.

3. The liquid crystal display panel according to claim 1, wherein the LCD panel has a tri-gate pixel configuration.

4. The liquid crystal display panel according to claim 1, further comprising a data driver for driving the (4y+1)-th data line, the (4y+2)-th data line, the (4y+3)-th data line, the (4y+4)-th data line and the (4y+5)-th data line by a column inversion driving method.

5. The liquid crystal display panel according to claim 1, further comprising a gate driver module, wherein the gate driver module comprises:

a gate driver comprising a first shift register unit, a second shift register unit, a third shift register unit, a fourth shift register unit, a fifth shift register unit, a sixth shift register unit, a seventh shift register unit and an eighth shift register unit, wherein the first shift register unit generates a first gate pulse according to a first clock signal, the second shift register unit generates a second gate pulse according to a second clock signal, the third shift register unit generates a third gate pulse according to a third clock signal, the fourth shift register unit generates a fourth gate pulse according to a fourth clock signal, the fifth shift register unit generates a fifth gate pulse according to the first clock signal, the sixth shift register unit generates a sixth gate pulse according to the second clock signal, the seventh shift register unit generates a seventh gate pulse according to the third clock signal, and the eighth shift register unit generates an eighth gate pulse according to the fourth clock signal; and a wiring zone for transmitting the first gate pulse to the (6x+3)-th gate line, transmitting the second gate pulse to the (6x+1)-th gate line, transmitting the third gate pulse to the (6x+4)-th gate line, transmitting the fourth gate pulse to the (6x+2)-th gate line, transmitting the fifth gate pulse to the (6x+7)-th gate line, transmitting the sixth gate pulse to the (6x+5)-th gate line, transmitting the seventh gate pulse to the (6x+8)-th gate line, and transmitting the eighth gate pulse to the (6x+6)-th gate line, wherein the first clock signal, the second clock signal, the third clock signal and the fourth clock signal have the same frequency, and the phase difference between any two adjacent clock signals of the first clock signal, the second clock signal, the third clock signal and the fourth clock signal is 90 degrees.

6. A liquid crystal display (LCD) panel, comprising:

plural gate lines;

plural data lines; and plural basic arrangement groups, wherein each of the basic arrangement groups comprises:

a first row comprising a first sub-pixel, a second sub-pixel, a third sub-pixel and a fourth sub-pixel corresponding to a first color, wherein a switching element of the first sub-pixel has a control terminal directly connected to the (6x+1)-th gate line, a first terminal directly connected to the (4y+2)-th data line, and a second terminal directly connected to a corresponding storage unit; a switching element of the second sub-pixel has a control terminal directly connected to the (6x+2)-th gate line, a first terminal directly connected to the (4y+2)-th data line, and a second terminal directly connected to a corresponding storage unit; a switching element of the third sub-pixel has a control terminal directly connected to the (6x+1)-th gate line, a first terminal directly connected to the (4y+3)-th data line, and a second terminal directly connected to a corresponding storage unit; a switching element of the fourth sub-pixel has a control terminal directly connected to the (6x+2)-th pate line, a first terminal directly connected to the (4y+5)-th data line, and a second terminal directly connected to a corresponding storage unit;

a second row comprising a fifth sub-pixel, a sixth sub-pixel, a seventh sub-pixel and an eighth sub-pixel corresponding to a second color, wherein a switching element of the fifth sub-pixel has a control terminal directly connected to the (6x+3)-th gate line, a first terminal directly connected to the (4y+1)-th data line, and a second terminal directly connected to a corresponding storage unit; a switching element of the sixth sub-pixel has a control terminal directly connected to the (6x+2)-th gate line, a first terminal directly connected to the second data line (4y+3)-th, and a second terminal directly connected to a corresponding storage unit; a switching element of the seventh sub-pixel has a control terminal directly connected to the (6x+3)-th gate line, a first terminal directly connected to the (4y+4)-th data line, and a second terminal directly connected to a corresponding storage unit; and a switching element of the eighth sub-pixel has a control terminal directly connected to the (6x+2)-th gate line, a first terminal directly connected to the (4y+4)-th data line, and a second terminal directly connected to a corresponding storage unit;

a third row comprising a ninth sub-pixel, a tenth sub-pixel, an eleventh sub-pixel and a twelfth sub-pixel corresponding to a third color, wherein a switching element of the ninth sub-pixel has a control terminal directly connected to the (6x+3)-th gate line, a first terminal directly connected to the (4y+2)-th data line, and a second terminal directly connected to a corresponding storage unit; a switching element of the tenth sub-pixel has a control terminal directly connected to the (6x+4)-th gate line, a first terminal directly connected to the (4y+2)-th data line, and a second terminal directly connected to a corresponding storage unit; a switching element of the eleventh sub-pixel has a control terminal directly connected to the (6x+3)-th gate line, a first terminal directly connected to the (4y+3)-th data line, and a second terminal directly connected to a corresponding storage unit; and a switching element of the twelfth sub-pixel has a control terminal directly connected to the (6x+4)-th gate line, a first terminal directly connected to the (4y+5)-th data line, and a second terminal directly connected to a corresponding storage unit;

a fourth row comprising a thirteenth sub-pixel, a fourteenth sub-pixel, a fifteenth sub-pixel and a sixteenth sub-pixel corresponding to the first color, wherein a switching element of the thirteenth sub-pixel has a control terminal directly connected to the (6x+5)-th gate line, a first terminal directly connected to the (4y+1)-th data line, and a second terminal directly connected to a corresponding storage unit; a switching element of the fourteenth sub-pixel has a control terminal directly connected to the (6x+4)-th gate line, a first terminal directly connected to the (4y+3)-th data line, and a second terminal directly connected to a corresponding storage unit; a switching element of the fifteenth sub-pixel has a control terminal directly connected to the (6x+5)-th gate line, a first terminal directly connected to the (4y+4)-th data line, and a second terminal directly connected to a corresponding storage unit; and a switching element of the sixteenth sub-pixel has a control terminal directly connected to the (6x+4)-th gate line, a first terminal directly connected to the (4y+4)-th data line, and a second terminal directly connected to a corresponding storage unit;

a fifth row comprising a seventeenth sub-pixel, an eighteenth sub-pixel, a nineteenth sub-pixel and a twentieth sub-pixel corresponding to the second color, wherein a switching element of the seventeenth sub-pixel has a control terminal directly connected to the (6x+5)-th gate line, a first terminal directly connected to the (4y+2)-th data line, and a second terminal directly connected to a corresponding storage unit; a switching element of the eighteenth sub-pixel has a control terminal directly connected to the (6x+6)-th gate line, a first terminal directly connected to the (4y+2)-th data line, and a second terminal directly connected to a corresponding storage unit; a switching element of the nineteenth sub-pixel has a control terminal directly connected to the (6x+5)-th gate line, a first terminal directly connected to the (4y+3)-th data line, and a second terminal directly connected to a corresponding storage unit; and a switching element of the twentieth sub-pixel has a control terminal directly connected to the (6x+6)-th gate line, a first terminal directly connected to the (4y+5)-th data line, and a second terminal directly connected to a corresponding storage unit; and a sixth row comprising a twenty-first sub-pixel, a twenty-second sub-pixel, a twenty-third sub-pixel and a twenty-fourth sub-pixel corresponding to the third color, wherein a switching element of the twenty-first sub-pixel has a control terminal directly connected to the (6x+7)-th gate line, a first terminal directly connected to the (4y+1)-th data line, and a second terminal directly connected to a corresponding storage unit; a switching element of the twenty-second sub-pixel has a control terminal directly connected to the (6x+6)-th gate line, a first terminal directly connected to the (4y+3)-th data line, and a second terminal directly connected to a corresponding storage unit; a switching element of the twenty-third sub-pixel has a control terminal directly connected to the (6x+7)-th gate line, a first terminal directly connected to the (4y+4)-th data line, and a second terminal directly connected to a corresponding storage unit; and a switching element of the twenty-fourth sub-pixel has a control terminal directly connected to the (6x+6)-th gate line, a first terminal directly connected to the (4y+4)-th data line, and a second terminal directly connected to a corresponding storage unit, wherein x is zero or a positive integer, and y is zero or a positive integer.

7. The liquid crystal display panel according to claim 6, wherein the first color is a red color, the second color is a green color, and the third color is a blue color.

8. The liquid crystal display panel according to claim 6, wherein the LCD panel has a tri-gate pixel configuration.

9. The liquid crystal display panel according to claim 6, further comprising a data driver for driving the (4y+1)-th data line, the (4y+2)-th data line, the (4y+3)-th data line, the (4y+4)-th data line and the (4y+5)-th data line by a column inversion driving method.

10. The liquid crystal display panel according to claim 6, further comprising a gate driver module, wherein the gate driver module comprises:

a gate driver comprising a first shift register unit, a second shift register unit, a third shift register unit, a fourth shift register unit, a fifth shift register unit, a sixth shift register unit, a seventh shift register unit and an eighth shift register unit, wherein the first shift register unit generates a first gate pulse according to a first clock signal, the second shift register unit generates a second gate pulse according to a second clock signal, the third shift register unit generates a third gate pulse according to a third clock signal, the fourth shift register unit generates a fourth gate pulse according to a fourth clock signal, the fifth shift register unit generates a fifth gate pulse according to the first clock signal, the sixth shift register unit generates a sixth gate pulse according to the second clock signal, the seventh shift register unit generates a seventh gate pulse according to the third clock signal, and the eighth shift register unit generates an eighth gate pulse according to the fourth clock signal; and a wiring zone for transmitting the first gate pulse to the (6x+3)-th gate line, transmitting the second gate pulse to the (6x+1)-th gate line, transmitting the third gate pulse to the (6x+4)-th gate line, transmitting the fourth gate pulse to the (6x+2)-th gate line, transmitting the fifth gate pulse to the (6x+7)-th gate line, transmitting the sixth gate pulse to the (6x+5)-th gate line, transmitting the seventh gate pulse to the (6x+8)-th gate line, and transmitting the eighth gate pulse to the (6x+6)-th gate line, wherein the first clock signal, the second clock signal, the third clock signal and the fourth clock signal have the same frequency, and the phase difference between any two adjacent clock signals of the first clock signal, the second clock signal, the third clock signal and the fourth clock signal is 90 degrees.

* * * * *